US012460857B2

(12) United States Patent
Park et al.

(10) Patent No.: US 12,460,857 B2
(45) Date of Patent: Nov. 4, 2025

(54) REFRIGERATOR

(71) Applicant: LG Electronics Inc., Seoul (KR)

(72) Inventors: Dongwoo Park, Seoul (KR); Juho Lee, Seoul (KR); Juhye An, Seoul (KR)

(73) Assignee: LG Electronics Inc., Seoul (KR)

( * ) Notice: Subject to any disclaimer, the term of this patent is extended or adjusted under 35 U.S.C. 154(b) by 233 days.

(21) Appl. No.: 18/203,948

(22) Filed: May 31, 2023

(65) Prior Publication Data

US 2023/0417481 A1 Dec. 28, 2023

(30) Foreign Application Priority Data

Jun. 27, 2022 (KR) ..... 10-2022-0078426

(51) Int. Cl.
*F25D 23/06* (2006.01)

(52) U.S. Cl.
CPC ..... *F25D 23/062* (2013.01)

(58) Field of Classification Search
CPC ..... F25D 23/062; F25D 23/003; F25D 23/006
See application file for complete search history.

(56) References Cited

U.S. PATENT DOCUMENTS

| | | | | |
|---|---|---|---|---|
| 4,490,990 | A * | 1/1985 | Chastine | F25D 23/006 62/448 |
| 2005/0115265 | A1* | 6/2005 | Ozaki | B64D 13/06 62/298 |
| 2019/0285355 | A1* | 9/2019 | Lee | F25D 23/006 |
| 2020/0260667 | A1* | 8/2020 | Oh | F25D 23/003 |
| 2021/0140703 | A1* | 5/2021 | Wong | F25D 23/062 |
| 2021/0199366 | A1* | 7/2021 | Gochika | F25D 23/003 |
| 2022/0205705 | A1* | 6/2022 | Chhajed | F25D 23/006 |
| 2022/0397329 | A1* | 12/2022 | Goh | F25D 23/003 |
| 2023/0054907 | A1* | 2/2023 | Nalini | F24F 13/32 |

FOREIGN PATENT DOCUMENTS

| | | |
|---|---|---|
| EP | 2669610 | 12/2013 |
| JP | 2013-204902 | 10/2013 |
| WO | WO 2014/201892 | 12/2014 |

OTHER PUBLICATIONS

Extended European Search Report in European Appln. No. 23181016.9, mailed on Nov. 13, 2023, 8 pages.

* cited by examiner

*Primary Examiner* — Daniel J Rohrhoff
(74) *Attorney, Agent, or Firm* — Fish & Richardson P.C.

(57) ABSTRACT

A refrigerator includes: a cabinet defining a storage space, a door configured to open and close the storage space, a hinge rotatably coupling the door to the cabinet, and a reinforcement member provided at a first side opposite to the hinge among left and right sides of a lower surface of the cabinet and configured to block deformation of the cabinet.

16 Claims, 14 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2022-0078426, filed on Jun. 27, 2022, the disclosure of which is hereby incorporated by reference in its entirety.

TECHNICAL FIELD

The present disclosure relates to a refrigerator.

BACKGROUND

The present disclosure relates to a refrigerator.

In general, a refrigerator is a home appliance that allows food to be stored at a low temperature in an internal storage space shielded by a refrigerator door and is configured so that the stored food can be stored in an optimal state by cooling the inside of the storage space using cold air generated through heat exchange with the refrigerant circulating in the refrigeration cycle.

As such, refrigerators are gradually becoming larger and multifunctional according to changes in dietary habits and the trend of luxury products, and refrigerators with various structures and convenience devices in consideration of user convenience are being released.

In addition, in order to harmonize with the environment in which the refrigerator is disposed or with surrounding furniture or home appliances, structures for varying the outer appearance of the front surface of the door of the refrigerator have been developed. In addition, the refrigerator has been developed in which the outer appearance of the front surface of the door is variously configured in order to harmonize the refrigerator with surrounding furniture or home appliances and to implement an outer appearance that meets the user's preference.

Further, in order to improve the outer appearance of the front surface of the refrigerator door, refrigerators in which the front surface of the refrigerator door is formed of various materials such as metal, glass, or ceramic material have been developed.

However, in the refrigerators according to the prior art, the weight of the materials forming the outer appearance of the door increases, and thus, a high load is applied to the cabinet to which the door is connected.

In particular, when the door is configured as a rotatable door, a load may be concentrated on one end on which a hinge is mounted, and thus the load may be concentrated on one side of the cabinet, thereby causing a problem in that the cabinet is distorted or deformed. The deformation problem of such a cabinet becomes more serious as the door becomes heavier and the door becomes larger.

In addition, when the cabinet is deformed, a problem in which the rotary door is tilted may occur and when a plurality of doors are provided, there is a problem in that the gap between the neighboring door or other neighboring furniture and the home appliance is not constant, resulting in poor outer appearance.

SUMMARY

An object of an embodiment of the present disclosure is to provide a refrigerator that prevents a cabinet from being deformed due to an increase in the weight of a door.

An object of an embodiment of the present disclosure is to provide a refrigerator in which a load is concentrated on one side of both side surfaces of a cabinet to prevent the cabinet from being deformed.

An object of an embodiment of the present disclosure is to provide a refrigerator that prevents distortion of a cabinet by reinforcing a structure of a machine room.

A refrigerator according to an embodiment of the present disclosure may include a cabinet having a storage space with an open front surface; a door opening and closing the storage space; a hinge device rotatably connecting the door to the cabinet; and a reinforcement member provided on one side far from the hinge device among left and right sides of a lower surface of the cabinet and preventing deformation of the cabinet.

The reinforcement member may be disposed at a corner formed by a rear surface, a side surface, and a lower surface of the cabinet.

The reinforcement member may be seated on the lower surface of the cabinet and is formed to further contact at least one surface of the side surface and the rear surface.

The reinforcement member may be mounted on a lower surface of the cabinet and is exposed toward a bottom surface in which the refrigerator is installed.

A machine room in which a compressor is accommodated may be formed at a lower end of the rear surface of the cabinet, and the reinforcement member may be provided in the machine room.

The reinforcement member may be mounted on a corner formed by a lower surface of the machine room and a side surface of the machine room and may support both upper surface and lower surface.

The reinforcement member may include a lower surface portion seated on the bottom surface of the machine room; a side portion that is bent upward along a circumference of the lower surface portion and that contacts a side surface of the cabinet.

The machine room may include a base which forms the bottom surface of the machine room and on which on which the compressor is mounted, and the reinforcement member may be mounted on a side end of the base.

Both side surfaces of the machine room in a left and right direction may be formed by an outer case forming an outer appearance of the cabinet, and the lower surface portion may be supported by the base, and the side portion may be supported by the outer case.

The base may include a bottom portion forming an edge of the machine room; and a recessed portion that is recessed downward from the bottom portion and in which the compressor is disposed, and the reinforcement member may be mounted on the bottom portion.

The inner end of the lower surface portion may be formed along the outer side of the recessed portion, and the outer end of the lower surface portion may be formed along the outer side of the bottom portion.

The base may extend upward along a circumference of the bottom portion and may have an edge portion coupled to a circumferential surface of the machine room, and the side portion may be formed to contact the edge portion.

The lower portion may include a first lower surface portion extending along the side end of the machine room; a second lower surface portion extending along the front end of the machine room from a front end of the first lower surface portion; and a third lower surface portion extending along the rear end of the machine room from a rear end of the first lower surface portion.

The side portion may include first side surface portions extending from the first lower surface portion and supporting opposite side surfaces of the cabinet; a second side surface portion extending from the second lower surface portion and supporting a front surface plate forming the front surface of the machine room; and a third side surface portion extending from the third lower surface portion and supporting an edge portion extending upward along the circumference of the bottom portion.

The reinforcement member may include a lower surface portion in contact with the lower surface of the machine room; and a side portion that is bent downward along the circumference of the lower surface portion, and the side portion may be formed along the circumferences of the side end, front end, and rear end of the lower surface of the machine room.

The refrigerator of claim may further include a reinforcement frame made of metal material which is provided along the edge of the lower surface and the side surface of the machine room, and on which the reinforcement member is seated, in which the reinforcement member may be fixed by a fastening member penetrating the lower surface of the machine room and the reinforcement frame.

The reinforcement frame may include a horizontal portion in contact with one end of the lower surface of the machine room and the lower end of the side surface of the outer case forming both side surfaces of the cabinet; and a vertical portion in contact with one end of the rear surface of the machine room and the rear end of the side surface of the outer case, and the reinforcement member may be seated on the horizontal portion.

The refrigerator may further include a base forming a lower surface of the machine room; and a lower bending portion bent to come into contact with the base at the lower end of the outer case forming both side surfaces of the cabinet; in which the reinforcement member may be fixed by a fastening member passing through the base, the lower bending portion, and the reinforcement member.

The reinforcement member may be provided at both ends of the bottom surface of the machine room in the left and right direction.

The reinforcement member may be formed of a metal material and is formed of a material having higher strength than the cabinet.

In the refrigerator according to the proposed embodiment, the following effects can be expected.

In the refrigerator according to the embodiment of the present disclosure, even if the weight of the door increases due to the installation of the panel assembly or the like, there is an advantage in that a reinforcement member is disposed at the lower side end of the machine room opposite to the hinge axis of the door to prevent distortion of the cabinet.

Even if the weight of the door increases, the cabinet can maintain the design state thereof by the reinforcement member, and, accordingly, when a plurality of doors are disposed, the gap between the doors, the horizontal state of the doors, or the like can be maintained and thus there is an advantage in that it is possible to prevent outer appearance defects. In addition, even in a built-in installation structure in which the refrigerator is disposed side by side with furniture or other home appliances, the shape and spacing of the cabinet can be maintained, thereby preventing the outer appearance defects.

In addition, since the reinforcement member is disposed on the bottom surface of the machine room, loss of the internal space of the machine room can be prevented, and the disposition of the compressor and the condenser provided inside the machine room is not affected. In other words, there is an advantage in that the strength of the machine room and the cabinet can be reinforced while maintaining the internal volume of the machine room as it is.

In addition, the reinforcement member can reinforce the structural strength of the machine room, and thus there is an advantage of effectively preventing the deformation of the machine room, which is vulnerable to torsional load because the inside thereof is empty.

In addition, the reinforcement member is formed in a shape corresponding to the shape of the bottom surface and the circumferential surface of the machine room, so that the reinforcement member can reinforce the strength of the machine room only by being seated and coupled to the machine room, and thus there is an advantage in that the assembly operation is improved.

In addition, the reinforcement member is formed to be supported on all of the bottom surface, the front surface, the rear surface, and the side surface of the machine room, and thus there is an advantage in that it is possible to effectively prevent the cabinet from being twisted.

DETAILED DESCRIPTIONS

Hereinafter, specific embodiments of the present disclosure will be described in detail with drawings. However, the present disclosure cannot be said to be limited to the embodiments in which the spirit of the present disclosure is presented, and other disclosures that are degenerative by addition, change, deletion, or the like of other components or other embodiments included within the scope of the present disclosure can be easily suggested.

Before the description, the direction is defined. In the embodiment of the present disclosure, the direction in which the front surface of the door faces as illustrated in FIG. 1 can be defined as a front direction, the direction facing the cabinet with respect to the front surface of the door can be defined as a rear direction, the direction facing the bottom surface on which the refrigerator is installed can be defined as a downward direction, and the direction away from the bottom surface can be defined as upward direction.

Figure 1:
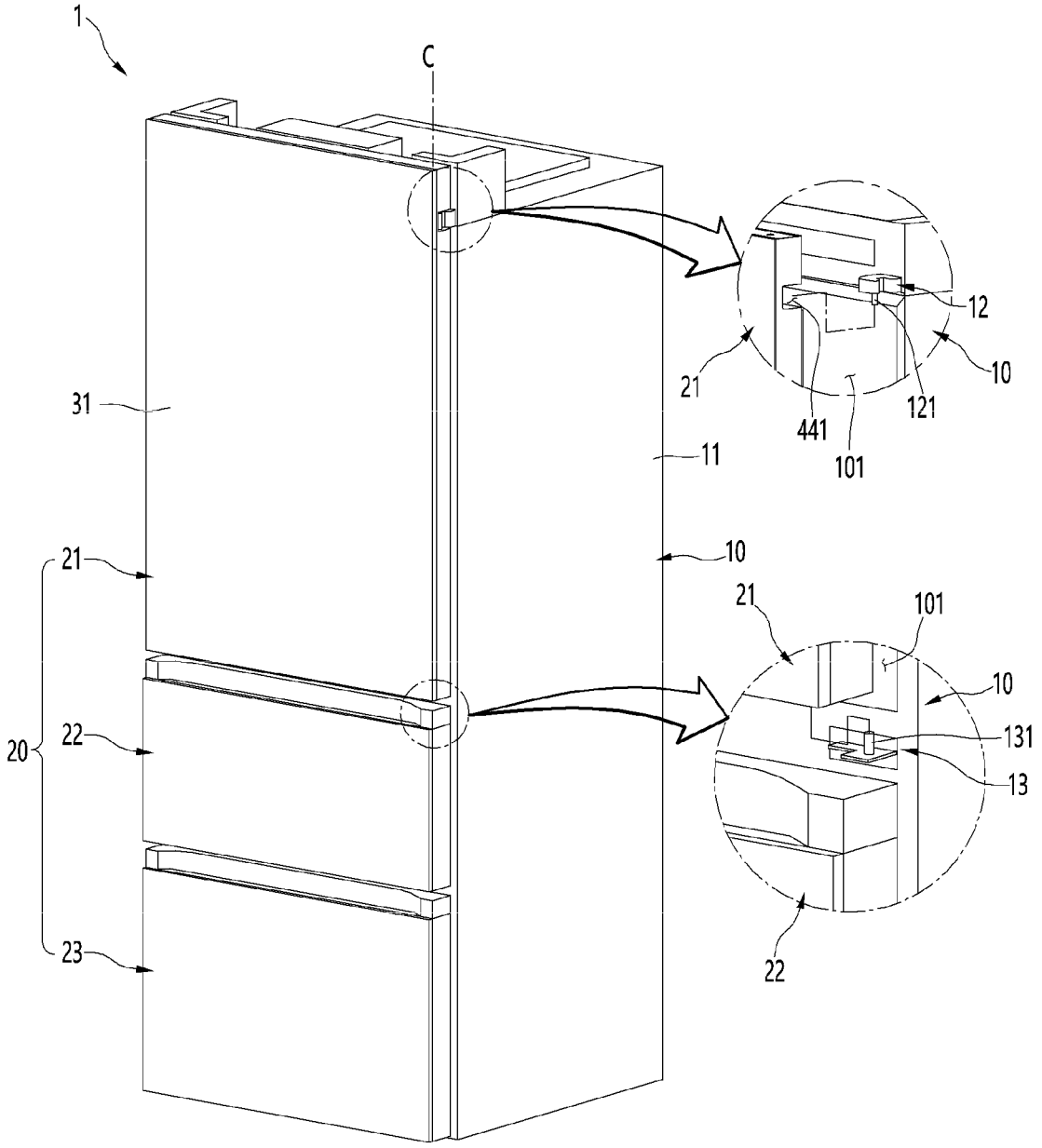
FIG. 1 is a perspective view illustrating a refrigerator according to an embodiment of the present disclosure.
Figure 2:
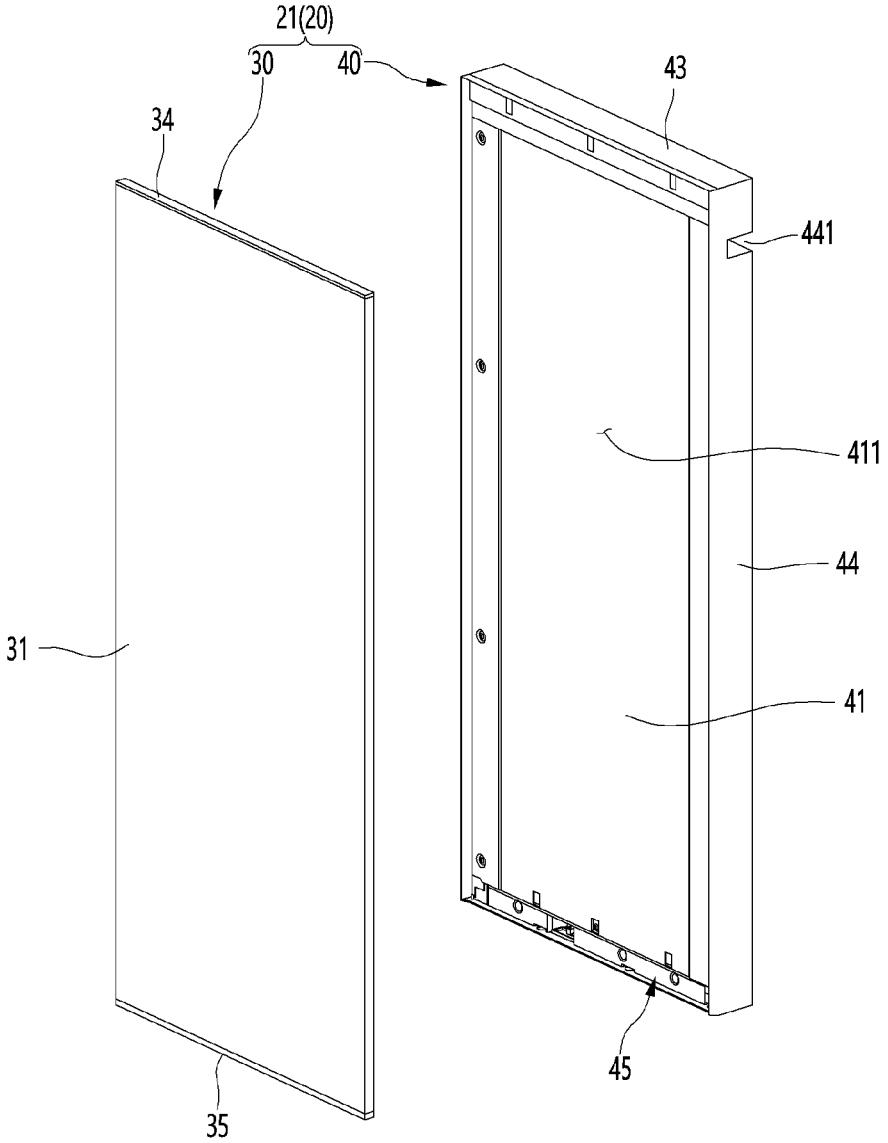
FIG. 2 is an exploded perspective view illustrating a door which is one configuration of the refrigerator.
Figure 3:
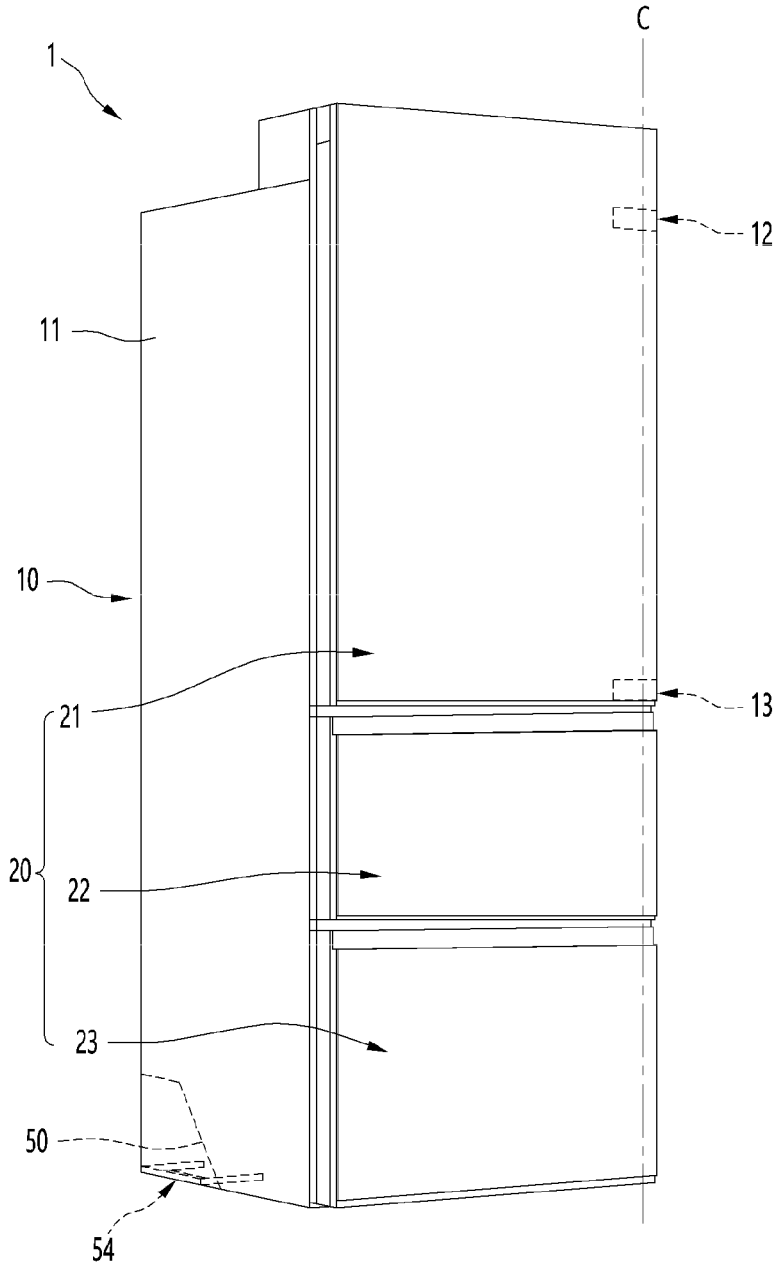
FIG. 3 is a perspective view illustrating an arrangement relationship between a reinforcement member and a rotation shaft of a door according to an embodiment of the present disclosure.

FIG. 1 is a perspective view illustrating a refrigerator according to an embodiment of the present disclosure, FIG. 2 is an exploded perspective view illustrating a door which is one configuration of the refrigerator, and FIG. 3 is a perspective view illustrating an arrangement relationship between a reinforcement member and a rotation shaft of a door according to an embodiment of the present disclosure.

As illustrated in the drawing, the overall outer appearance of a refrigerator 1 according to an embodiment of the present disclosure is formed by a cabinet 10 forming a storage space 101 having an open front surface, and a door 20 opening and closing the storage space 101.

The cabinet 10 may be formed in a hexahedral shape with an open front surface and may include an upper surface, a lower surface, left and right side surfaces, and a rear surface. In this case, each surface of the cabinet 10 may be formed by being connected to each other in at least one configuration.

A storage space 101 may be formed inside the cabinet 10, and a compressor 501, a condenser 502, an expansion device and an evaporator constituting a refrigeration cycle for cooling the storage space 101 are disposed inside the cabinet 10.

The interior of the cabinet 10 may be divided in the vertical direction to form a plurality of storage spaces. In addition, the divided storage spaces 101 may be maintained at different temperatures, respectively. For example, the storage space 101 may be divided into a refrigerating chamber and a freezing chamber.

A door 20 may be provided in front of the cabinet 10. The door 20 may form an outer appearance of the front surface of the refrigerator 1. The refrigerator 1 may be mounted to harmonize with furniture or walls in an indoor space. In addition, for this, the overall outer appearance of the front surface of the refrigerator 1 may be formed by the front surface of the door 20.

A plurality of doors 20 may be provided, and the door may be configured to open and close the corresponding storage space 101 independently of each other. For example, the door 20 may include a first door 21, a second door 22, and a third door 23 that are continuously disposed in the vertical direction. The first door 21 may open and close the storage space 101 by rotation. In addition, the second door 22 and the third door 23 may be configured to be drawn in and out like a drawer.

The size, shape, and number of the door 20 may be determined according to the disposition shape and number of the storage space 101, and in this embodiment, three doors will be provided as an example, but it should be noted in advance that the present disclosure is applicable to all refrigerators equipped with at least one rotating door.

The door 20 may be rotatably mounted to the cabinet 10 by an upper hinge 12 and a lower hinge 13. In addition, the storage space 101 may be opened and closed by rotation of the door 20. Accordingly, the door 20 may be referred to as a rotary door.

The door 20 may further extend upwardly of the cabinet 10 and may be rotatable by an upper hinge 12 mounted on the cabinet 10. The upper hinge 12 may rotatably connect an upper portion of the door 20 to the cabinet 10. In addition, the upper hinge 12 may be fixed to one end of both side ends of the upper surface of the cabinet 10 in the left and right direction.

The upper hinge 12 may include an upper hinge shaft 121 protruding downward. In addition, the upper hinge shaft 121 may be shaft-coupled to the hinge mounting portion 441 formed on the upper portion of the door 20. Accordingly, the door 20 may be rotated with respect to the upper hinge shaft 121.

The lower hinge 13 is provided on the front surface of the cabinet 10 and can rotatably support the door 20 from below. The lower hinge 13 may be located at one end of both side surfaces of the front surface of the cabinet 10 in the left and right direction and may be mounted in the same direction as the upper hinge 12.

In addition, the lower hinge 13 may include a lower hinge shaft 131 protruding upward. The lower hinge shaft 131 may be connected through the lower end of the door 20. Accordingly, the door 20 may be rotated with respect to the lower hinge shaft 131.

Meanwhile, the upper hinge shaft 121 and the lower hinge shaft 131 may be disposed on one side of both side surfaces of the front surface of the cabinet 10 in the left and right direction and may be provided on the same extension line in the vertical direction. In other words, the rotation axis C of the door 20 may be positioned on the same extension line as the upper hinge shaft 121 and the lower hinge shaft 131. In addition, the rotation axis C of the door 20 may be located on one of both side surfaces in the left and right direction by the upper hinge 12 and the lower hinge 13. For example, the rotation axis C of the door 20 is located on the right side (as seen in FIG. 1) of the door 20, and the upper hinge 12 and the lower hinge 13 supporting the door 20. may also be provided on the right side (as seen in FIG. 1) of the cabinet 10.

The door 20 may include a door body 40 that forms the overall shape of the door 20 and opens and closes the storage space, and a panel assembly 30 that forms the outer appearance of the front surface of the door 20.

The door body 40 may include a body plate 41 forming a front surface and a door liner forming a rear surface. The body plate 41 may be formed of a metal material and may be disposed to face the rear surface of the panel assembly 30. In addition, the door liner may be formed of a plastic material and may form the shape of the rear surface of the door 20.

In addition, the door body 40 may include side decorations 44 forming both side surfaces of the door body 40 in the left and right direction. The side decoration 44 may extend in a vertical direction, and an upper end thereof may be coupled with an upper cap decoration 43 and a lower end thereof may be coupled with a lower cap decoration 45.

The door body 40 may include an upper cap deco 43 and a lower cap deco 45 forming an upper surface and a lower surface of the door body 40. In addition, an adiabatic material can be filled in the space inside the door body 40 formed by the coupling of the body plate 41, the door liner, the side decoration 44, the upper cap decoration 43, and the lower cap decoration 45.

Meanwhile, in a state where the door body 40 is assembled, a recessed accommodation space 411 may be formed on the front surface of the door body 40 to accommodate the panel assembly 30. The panel assembly 30 may be mounted in the accommodation space 411 in a state where a plurality of components are assembled into one assembly. The panel assembly 30 may have a size corresponding to the accommodation space 411. The panel assembly 30 may be in contact with the upper cap decor 43, the lower cap decor 45, and the side decor 44 while being mounted on the door body 40.

In addition, the panel assembly 30 may be detachably attached to the door body 40 as necessary. In addition, although not illustrated in detail, the panel assembly 30 is coupled to the door body 40 to maintain a sturdy mounting state even when the door 20 is opened and closed.

The panel assembly 30 is formed in a plate shape and may form an outer appearance of the front surface of the door 20 in a state of being mounted on the front surface of the door body 40. Since the panel assembly 30 forms the outer appearance of the front surface of the door 20, the panel assembly may be referred to as a door panel, and since the panel assembly forms the outer appearance of the front surface of the refrigerator 1, the panel assembly may be referred to as an exterior panel.

The door 20 can completely cover the cabinet 10 from the front in a closed state, thus forming the outer appearance of the refrigerator 1 when viewed from the front. In addition, the front surface of the door 20 may include various panels 31 suitable for the user's preference. In addition, an upper bracket 34 and a lower bracket 35 forming an upper surface and a lower surface of the panel assembly 30 may be further included.

The panel 31 may be formed of various materials such as metal, tempered glass, ceramic, and stone. In addition, when the panel assembly 30 including the panel 31 is mounted on the door 20, the weight of the door 20 increases. In addition, food may be stored in the door, and devices for other convenience are further disposed to increase the weight of the door, and a load can be operated eccentrically to one side of the cabinet 10 through the hinge devices 12 and 13. For example, the panel 31 has a front surface made of tempered glass, and a lighting device for illuminating the panel 31 and other components for coupling are further disposed therein, so that the weight of the door can increase.

Accordingly, the cabinet 10 may be deformed due to an increase in the weight of the door 20 and an increase in the load through the hinge devices 12 and 13. Accordingly, a reinforcement member 54 for preventing the cabinet 10 from being deformed is provided on one side of the cabinet 10 to prevent the cabinet 10 from being deformed, such as being distorted or tilted.

In particular, the reinforcement member 54 may be disposed on the far side in a diagonal direction with respect to the disposition positions of the hinge devices 12 and 13, that is, in a diagonal direction with respect to the rotation axis C of the door 20. Referring to FIG. 3, the rotation axis C of the door 20 may be located at the right end of the front surface of the cabinet 10, and the reinforcement member 54 may be located at the left end of the rear surface of the cabinet 10. In this case, the position of the reinforcement member 54 may be lower than the position of the hinge devices 12 and 13 when viewed with respect to the hinge devices 12 and 13, and among the both side surfaces in the left and right direction, and the reinforcement member may be disposed at the corner of a side far from the hinge device 12 and 13. For example, the reinforcement member 54 may be provided in the machine room 50 corresponding to corners of lower ends of the rear surface and the side surfaces of the cabinet 10.

In addition, when the first door 21 disposed above the other doors 22 and 23 among the doors 20 is coupled to the cabinet 10 by the hinge devices 12 and 13, the reinforcement member 54, which is disposed on one side of the cabinet 10, may be provided at least lower than the lower hinge 13 among the hinge devices 12 and 13.

In this way, the reinforcement member 54 may be disposed at a position where a torsional moment can be most applied by a load applied to the cabinet 10 through the hinge devices 12 and 13. Accordingly, it is possible to prevent torsional deformation of the cabinet 10 even with an increase in the weight of the door 20 to prevent the door 20 from being tilted, and the gap between the plurality of doors 21, 22, and 23 can be reduced.

Figure 4:
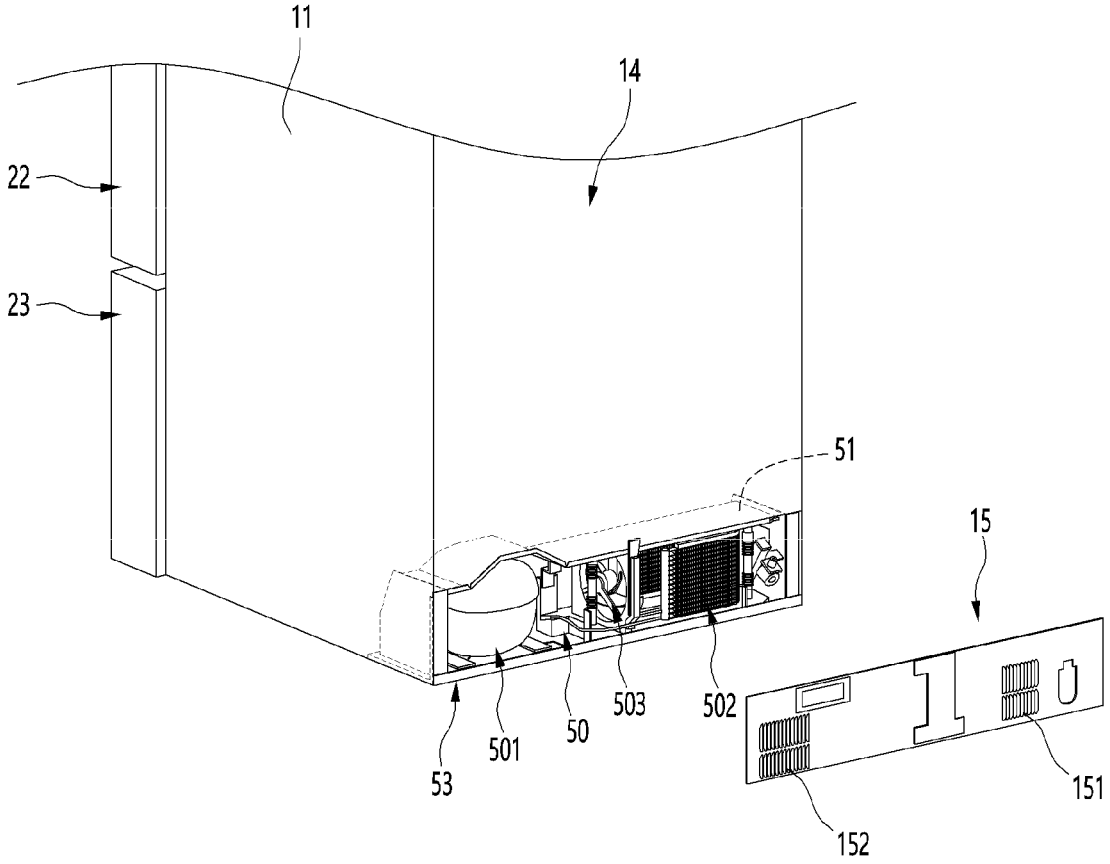
FIG. 4 is a partially exploded perspective view illustrating the structure of a machine room, which is one configuration of the refrigerator.
Figure 5:
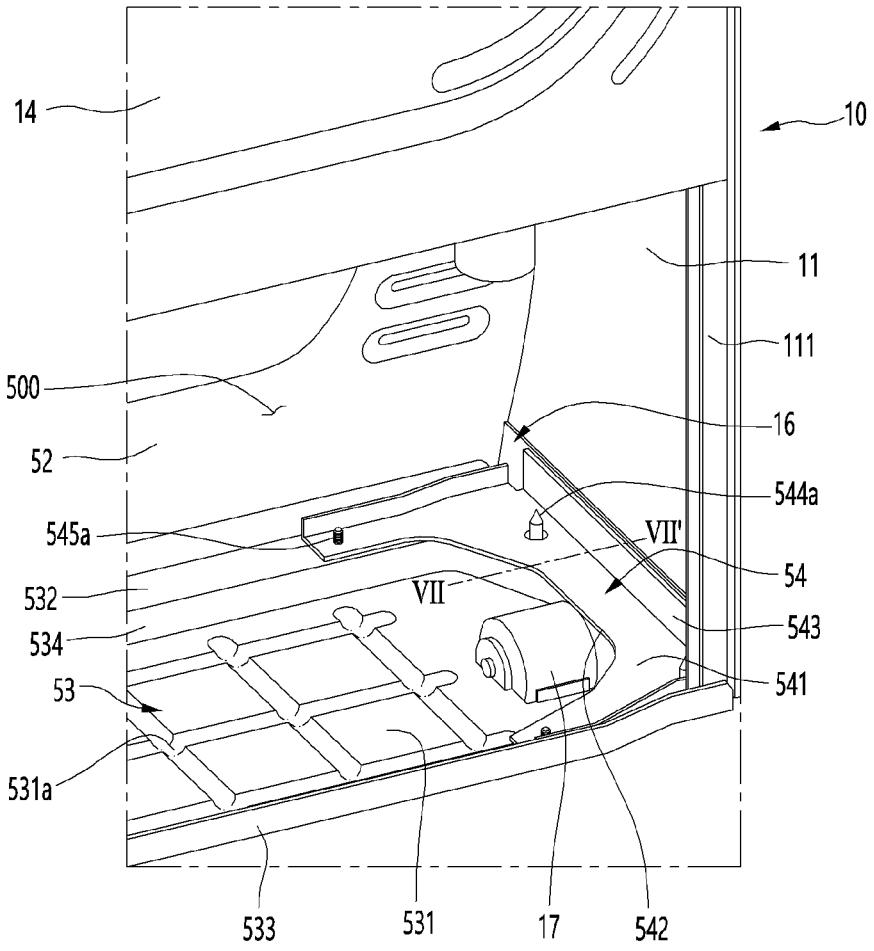
FIG. 5 is a partial perspective view illustrating the state of the machine room in which the reinforcement member is mounted.
Figure 6:
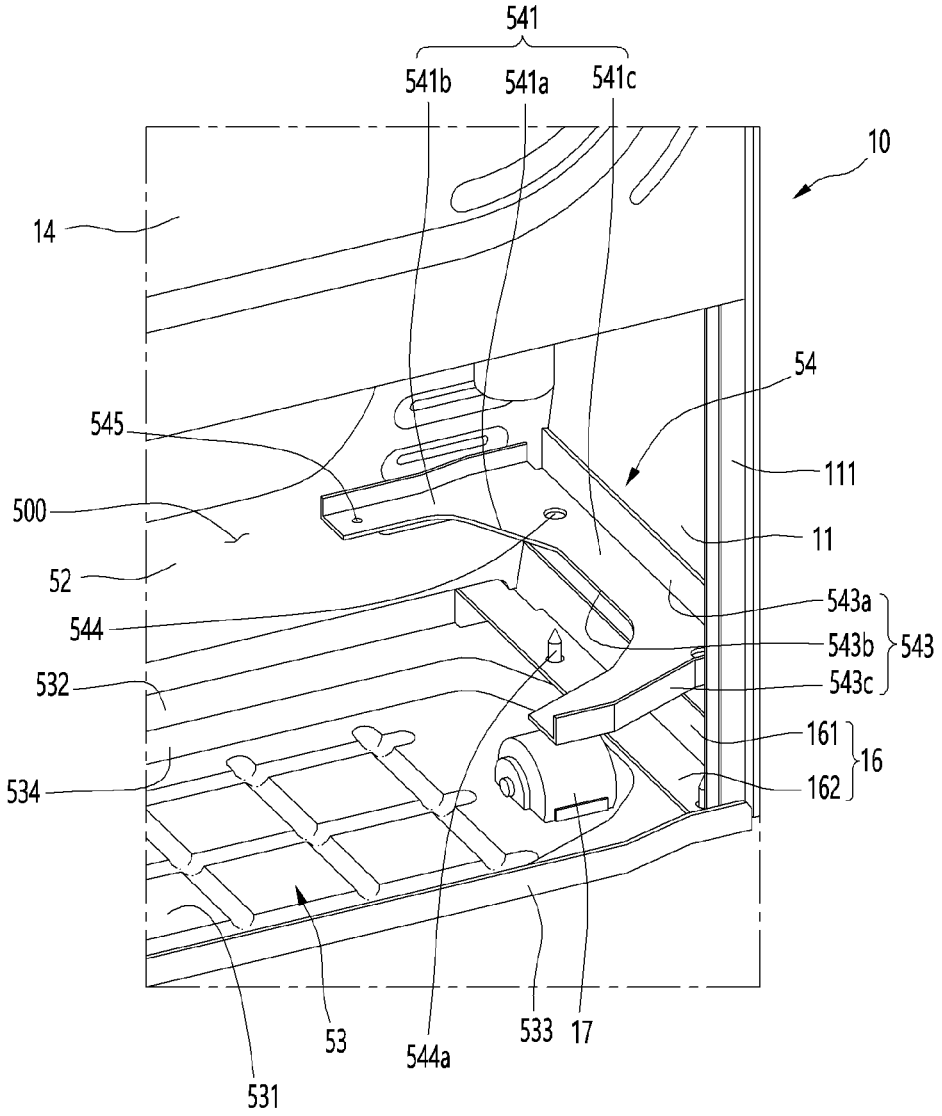
FIG. 6 is an exploded perspective view illustrating the mounting structure of the reinforcement member.
Figure 7:
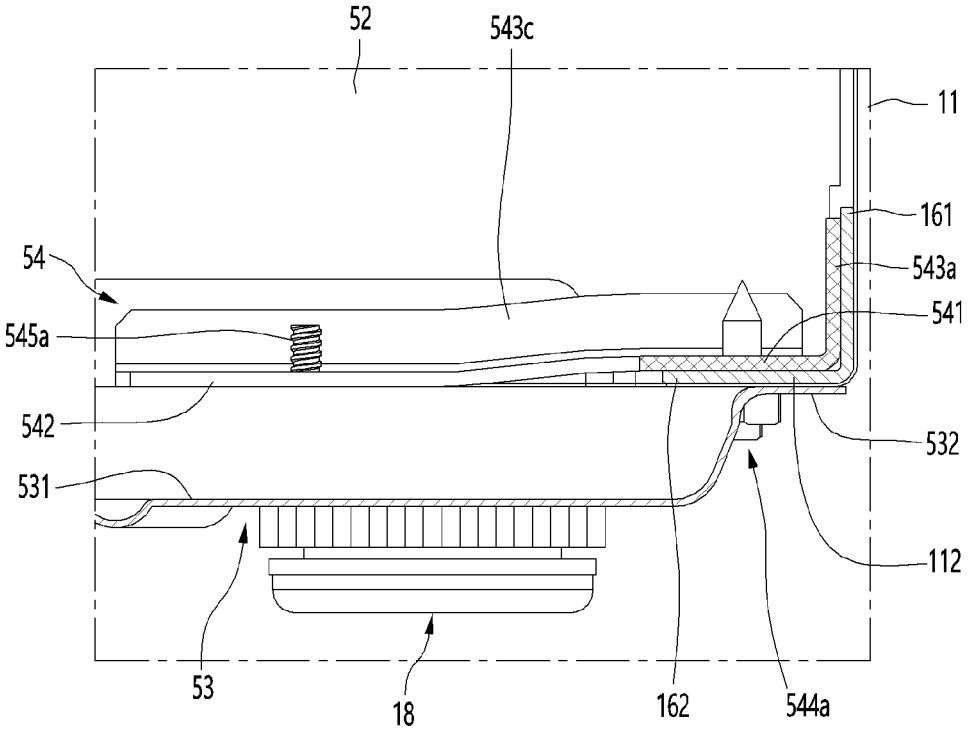
FIG. 7 is a cross-sectional view taken along line VII-VII' of FIG. 5.

FIG. 4 is a partially exploded perspective view illustrating the structure of a machine room, which is one configuration of the refrigerator, FIG. 5 is a partial perspective view illustrating the state of the machine room in which the reinforcement member is mounted, FIG. 6 is an exploded perspective view illustrating the mounting structure of the reinforcement member, and FIG. 7 is a cross-sectional view taken along line VII-VII' of FIG. 5.

As illustrated in the drawings, the cabinet 10 may have an outer shape formed by an outer case 11. The outer case 11 may be formed by bending a plate-shaped metal material, and may form the outer surface of the cabinet 10. For example, the outer case 11 may form at least both side surfaces in the left and right direction and an upper surface of the cabinet 10.

In addition, the rear surface of the cabinet 10 may be formed by the back plate 14. The back plate 14 may be coupled to both side surfaces of the outer case 11 and may extend downward from the upper end of the rear surface of the cabinet 10.

The cabinet 10 may further include an inner case forming the storage space 101. Adiabatic material by foaming may be formed in the inner space formed by the coupling of the outer case 11 and the inner case, the back plate 14 and the machine room 50.

The cabinet 10 may further include a machine room 50. A machine room 50 in which the compressor 501 and the condenser 502 constituting the refrigeration cycle are accommodated may be formed at the lower end of the cabinet 10. The machine room 50 may be formed to be opened through the rear surface of the cabinet 10.

The back plate 14 may extend from the upper end of the rear surface of the cabinet 10 to the upper end of the machine room 50 to form a portion of the rear surface of the cabinet 10. In addition, the opened rear surface of the machine room 50 may be shielded by the machine room cover 15. Accordingly, the remaining portion of the outer appearance of the rear surface of the cabinet 10 can be formed by the machine room cover 15. In addition, the machine room cover 15 may have a suction port 151 through which external air is introduced and a discharge port 152 through which the air cooled by the compressor 501 and the condenser 502 is discharged.

The machine room 50 may have a lower surface formed by a base 53. In addition, the front surface plate 52 may be formed on the front end of the base 53, and the upper surface plate 51 may be formed on the upper end of the front surface plate 52. The front surface plate 52 and the upper surface plate 51 may be formed by bending one plate. In addition, both side surfaces of the machine room 50 in the left and right direction may be opened and may be shielded by the outer case 11. The overall shape of the machine room 50 may be formed by coupling both ends of the outer case 11, the base 53, the front surface plate 52, and the upper surface plate 51 and may form a space 500 with an open rear surface.

The base 53 may form a lower surface of the machine room 50 and a lower surface of the cabinet 10. Accordingly, the base 53 may be referred to as a lower surface of a cabinet, a lower surface of a machine room, and a lower plate. In addition, components provided in the machine room 50 may be mounted on the base 53. For example, the base 53 may include the compressor 501, the condenser 502, and a fan 503 for circulating air inside and outside the machine room 50.

The base 53 may be formed in a metal plate shape, and may have a structure that is bent multiple times to provide a space in which the components inside the machine room 50 are mounted. For example, the base 53 may include a recessed portion 531 and a bottom portion 532. In addition, the base 53 may further include the border portion 533.

In detail, a bottom portion 532 may be formed at an edge of the bottom surface of the base 53. The bottom portion 532 may be formed parallel to the ground and may be located higher than the recessed portion 531. In addition, the bottom portion 532 may form a circumference among the bottom surfaces of the base 53, and in particular, the both side surfaces in the left and right direction may be formed to have a predetermined area to provide a surface on which the reinforcement member 54 to be described below is disposed.

The recessed portion 531 may be formed to be recessed downward from the bottom portion 532, and a predetermined area including the center of the bottom surface of the base 53 may be recessed to be stepped from the bottom portion 532. The recessed portion 531 may be recessed by a predetermined depth to secure a mounting space for the compressor 501 and the condenser 502 inside the machine room 50. In addition, since the bottom surface of the base 53 is provided with the recessed portion 531 and the bottom portion 532 to provide a stepped structure and thus strength may be reinforced.

Meanwhile, a grid-shaped reinforcement portion 531*a* may be formed inside the recessed portion 531. The reinforcement portion 531*a* may be composed of a plurality of grooves intersecting in the horizontal and vertical directions, and to prevent deformation of the bottom surface of the machine room 50 and components disposed therein can be effectively supported, by reinforcing the strength of the entire recessed portion 531.

In addition, a roller 17 for moving the refrigerator may be mounted on the base 53. The rollers 17 may be provided on both side surfaces of the recessed portion 531 in the left and right direction, respectively and may facilitate movement of the cabinet 10. In addition, a supporter 18 may be further provided on the base 53. The supporter 18 may be provided on the bottom surface of the base 53, that is, the recessed portion 531 or the bottom portion 532, and may be provided on both side surfaces in the left and right direction, respectively, to be in contact with the ground. The supporter 18 may be screwed to the base 53 to enable height adjustment by rotation. Accordingly, the inclination and horizontality of the refrigerator 1 can be adjusted by adjusting the height of the supporter 18.

A circumferential portion 534 connecting the outer end of the recessed portion 531 and the inner end of the bottom portion 532 may be formed. The circumferential portion 534 may extend in the vertical direction and may form a boundary between the recessed portion 531 and the bottom portion 532.

The bottom portion 532 may be formed above the recessed portion 531 in parallel with the recessed portion 531. The bottom portion 532 may extend outwardly from the upper end of the circumferential portion 534 to form a flat surface. In particular, a surface on which the reinforcement member 54 can be mounted may be provided on the bottom portion 532 forming both ends of the base 53 in the left and right direction.

The border portion 533 is formed along an outer end of the bottom portion 532 and may be bent upward. The border portion 533 may extend upward along at least the rear end of the bottom portion 532, that is, the rear end of the base 53, and both ends of the border portion 533 may be coupled with the side bending portion 111 bent of the outer case 11. In addition, the border portion 533 may extend upward along the front end of the bottom portion 532, and may be coupled to the lower end of the front surface plate 52.

Meanwhile, a lower bending portion 112 bent inside the machine room 50 may be formed at a lower end of the outer case 11. The lower bending portion 112 may be bent inside the machine room 50 from the lower ends of both side surfaces of the outer case 11. The lower bending portion 112 may be seated on an upper end of the bottom portion 532.

In addition, the reinforcement member 54 may be disposed in a state where the lower bending portion 112 is seated on the bottom portion 532. In other words, the lower bending portion 112 is positioned between the bottom portion 532 and the reinforcement member 54.

Meanwhile, a lower reinforcement frame 16 may be further provided along both side surfaces of the machine room 50. The lower reinforcement frame 16 may extend along the lower surface and corners of both side surfaces of the machine room 50 and may be formed of a metal material. In other words, the lower reinforcement frame 16 may include a lower frame lower surface 162 in contact with both ends of the bottom portion 532 and a lower frame side surface 161 in contact with a side surface of the outer case 11. In addition, the lower reinforcement frame 16 may be formed to form a skeleton of the lower end of both side surfaces of the machine room 50 as well as the lower end of both side surfaces of the cabinet 10. The lower frame lower surface 162 may be disposed between the reinforcement member 54 and the lower bending portion 112, and thus the strength of both side surfaces of the machine room 50 can be reinforced by the reinforcement member 54 and the lower reinforcement frame 16.

The reinforcement member 54 is for preventing the deformation of the machine room 50, and in particular, even if the load applied to the cabinet 10 increases because the heavy door 20 is mounted, the cabinet 10 reinforces the lower portion of the machine room 50 so that the shape is maintained without being distorted.

The door 20 is rotatably mounted on one side of the both side surfaces of the cabinet 10 in the left and right direction, and thus the cabinet 10 has the greatest amount of deformation in the direction opposite to the door 20. In other words, when the upper hinge 12 and the lower hinge 13 are provided on the right side of the front surface of the cabinet 10, the left corner of the both side surfaces of the machine room 50 in the left and right direction may be deformed.

Of the entire cabinet 10, the machine room 50 is not filled with an adiabatic material and is empty inside, so that when a load is applied to the cabinet 10 at an eccentric position, the machine room is the most vulnerable to torsion deformation.

Accordingly, the reinforcement member 54 may be provided on both sides of the machine room 50 in the left and right direction, but must be provided at least at a position opposite to the position where the hinge devices 12 and 13 are mounted, that is, on the left side of the machine room 50.

The reinforcement member 54 may be formed of a metal material having excellent strength. For example, the reinforcement member 54 may be formed of a metal material having a higher strength than the cabinet 10, that is, the outer case 11 or the base 53. In addition, the reinforcement member 54 is in close contact with the corners of the lower surface and side surfaces of the machine room 50 to prevent deformation of the cabinet 10 in addition to the machine room 50.

In this case, the reinforcement member 54 is formed along the side end portion of the machine room 50, and may be formed to support the corners formed by the lower surface and the side surface of the machine room 50. In addition, the reinforcement member 54 may be formed along the outer side of the bottom portion 532. In other words, the reinforcement member 54 may be formed to correspond to the shape of the bottom portion 532 of the side end of the base 53.

In detail, the reinforcement member 54 may include a lower surface portion 541 in contact with the base 53, and a side portion 543 formed along the circumference of the lower surface portion 541 to contact the outer case 11.

The lower surface portion 541 may be formed in a plate shape and may be mounted on one end of the bottom surface of the base 53. In detail, the lower surface portion 541 may be formed in a shape corresponding to the shape of the bottom portion of the side end of the base 53.

The lower surface portion 541 may include a first lower surface portion 541*a* extending along the side end of the bottom portion 532, a second lower surface portion 541*b* extending along the front end of the bottom portion 532 from the front end of the first lower surface portion 541*a*, and a third lower surface portion 541*c* extending along the rear end of the bottom portion 532 from the rear end of the first lower surface portion 541*a*.

Accordingly, the lower surface portion 541 is seated up to a portion of the front end and the rear end including the side end of the bottom portion 532, thereby effectively preventing distortion of the bottom of the base 53. To this end, the width of the lower surface portion 541 may be formed to correspond to the width of the bottom portion 532.

In addition, the shape of the inner (left side in FIGS. 5 and 6) end 542 of the lower surface portion 541 may be formed in a shape corresponding to the inner side, that is, the circumferential portion 534, of the bottom portion 532. The outer (right side in FIGS. 5 and 6) ends of the lower surface portion 541 may be in close contact with the outer case 11, the front surface plate 52, and the border portion 533.

In addition, fastening holes 544,545 in which fastening members 544*a* and 545*a* for coupling the reinforcement member 54 are mounted may be further formed in the lower surface portion 541. The fastening members 544*a* and 545*a* are fastened through the base 53 and the reinforcement member 54, so that the reinforcement member 54 can be firmly fixed to the lower surface portion 541. In addition, when the lower reinforcement frame 16 is provided between the base 53 and the reinforcement member 54, the fastening members 544*a* and 545*a* may pass through the base 53, the lower reinforcement frame 16, and the reinforcement member 54 in order to be coupled to each other. A plurality of the fastening holes 544 and 545 and the fastening members 544*a* and 545*a* may be provided along the lower surface portion 541, and different types of the fastening members 544*a* and 545*a* may be combined.

A side portion 543 may be formed at an outer end of the lower surface portion 541. The side portion 543 may be bent upwardly perpendicular to the lower surface portion 541. Accordingly, the reinforcement member 54 may be structurally more resistant to torsion or deformation due to the bent structure of the side portion 543.

In addition, the side portion 543 may be supported in contact with the outer case 11, the front surface plate 52, and the border portion 533 when the reinforcement member 54 is mounted. The side portion 543 may include a first side portion 543*a* in contact with the outer case 11, a second side portion 543*b* in contact with the front surface plate 52, and a third side portion 543*c* in contact with the border portion 533. The side portion 543 may be bent upward from the lower surface portion 541 and may be formed so that at least a portion of the outer case 11, the front surface plate 52, and the border portion 533 are in close contact with each other.

Meanwhile, when the lower reinforcement frame 16 is provided, the first side portion 543*a* does not directly contact the outer case 11 and may be combined to the lower frame side surface 161 in close contact with the outer case 11 to have a more robust fixing structure.

In the state where the reinforcement member 54 is mounted, the bottom surface of the base 53 may be supported by the reinforcement member 54, as well as the outer case 11, the front surface plate 52, and the border portion 533, and the entire surface forming the lower corner of the machine room 50 may be supported. Accordingly, even when a load that may cause distortion occurs in the cabinet 10, the corner portion of the machine room 50 can be completely maintained by the reinforcement member 54. In particular, the reinforcement member 54 is provided at a side end opposite to the side end at which the rotation axis C of the door 20 is disposed, so that it is possible to effectively prevent the deformation of the corner portion of the machine room 50 and thus the overall deformation of the cabinet.

Meanwhile, the refrigerator according to the embodiment of the present disclosure will be possible in various other embodiments in addition to the above-described embodiment. Another embodiment of the present disclosure is characterized in that it has a structure in which a reinforcement frame is further provided with a reinforcement member in the machine room. Accordingly, there are differences only in some structures of the reinforcement member and the structure of the reinforcement frame, and since other components are the same, descriptions and illustrations of the same components may be omitted, and it will be described using the same reference numerals.

Figure 8:
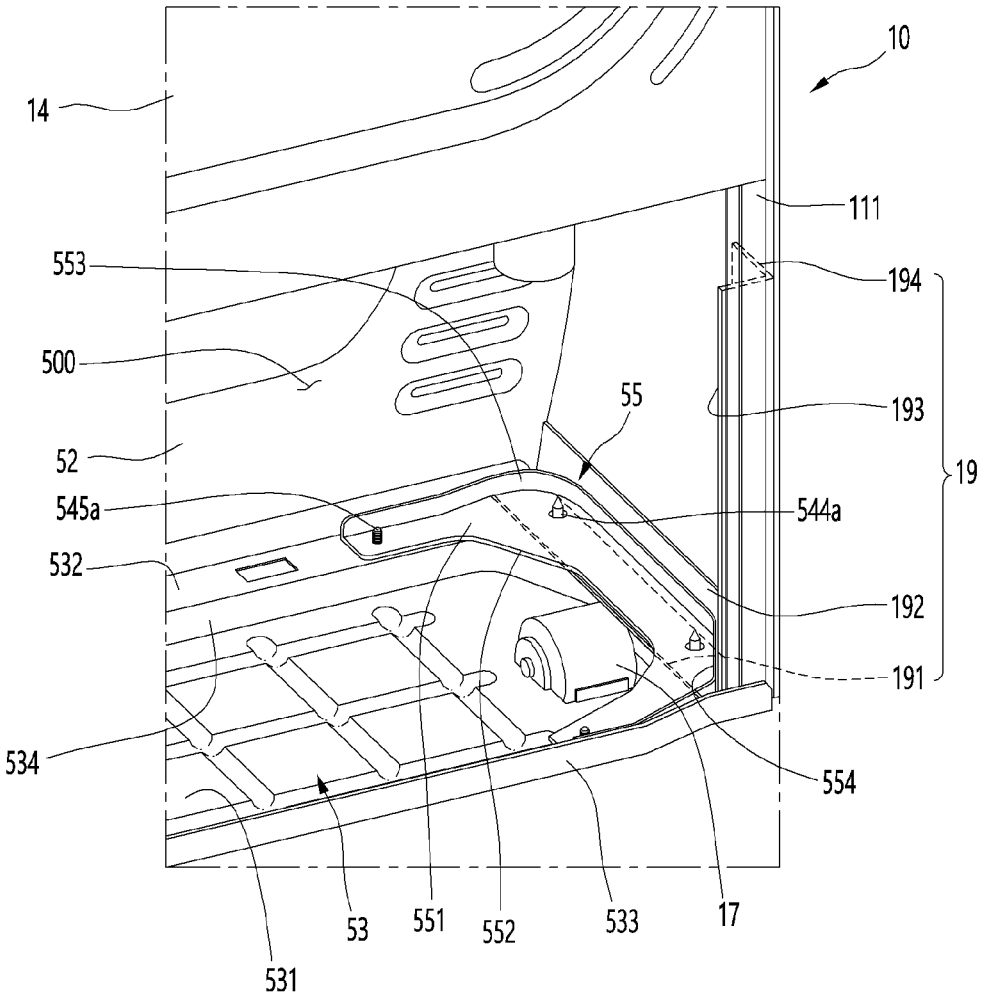
FIG. 8 is a partial perspective view illustrating a state of a machine room equipped with an additional reinforcement member according to another embodiment of the present disclosure.

FIG. 8 is a partial perspective view illustrating a state of a machine room equipped with an additional reinforcement member according to another embodiment of the present disclosure.

As illustrated in the drawing, a machine room 50 may be provided under the cabinet 10. In addition, the bottom surface of the machine room 50 may be formed by the base 53. In addition, the base 53 may be coupled to the front surface plate 52 and the outer plate 11 to form a space 500 inside the machine room 50.

In addition, a reinforcement frame 19 may be provided at the bent lower end and rear end, that is, the lower bending portion 112 and the side bending portion 111, of the outer plate 11. The reinforcement frame 19 may be formed of a metal material and may be formed to extend along the corners of the lower surface and the rear surface of the cabinet 10.

In detail, the reinforcement frame 19 may include a horizontal portion extending along the side end of the lower surface of the cabinet 10 and a vertical portion extending along the side end of the rear surface of the cabinet 10. The horizontal portion may include a first horizontal portion 191 in contact with a side end of the base 53 or the lower bending portion 112 and a second horizontal portion 192 in contact with a side surface of the outer case 11. In other words, the corner of one end of the machine room 50 can be in a strong reinforced state by the horizontal portion. In addition, the vertical portion may include a first vertical portion 193 in contact with the side bending portion 111 and a second vertical portion 194 in contact with a side surface of the outer case 11. In other words, the corner of the rear end of the machine room 50 by the vertical portion can be made to be in a strong reinforced state.

A rear end of the horizontal portion may be coupled to a lower end of the vertical portion. Of course, the horizontal portion and the vertical portion may be integrally formed. In addition, the reinforcement frame 19 forms at least a portion of the corner of the machine room 50 but may be formed along the corners of the lower surface and the rear surface of the cabinet 10 past the machine room 50. In addition, the reinforcement frame 19 may be fixed to the outer case 11 by a plurality of screws.

The base 53 may include a roller 17 and a reinforcement member 55. The base 53 may include a recessed portion 531, a bottom portion 532, and a border portion 533. An outer end of the recessed portion 531 and an inner end of the bottom portion 531 may be connected by the circumferential portion 5341. In addition, the reinforcement member 55 may be formed of a metal material and may be provided at a side end of the base 53.

The reinforcement member 55 may include a lower surface portion 551 seated on the bottom portion 532 and a side portion 553 in contact with the outer case 11. The lower surface portion 551 may be formed over a side end, a front end, and a portion of the rear end of the bottom portion 532 and may be formed in a plate shape corresponding to the shape of the bottom portion 532 to be in close contact with the bottom portion 532. In this case, the inner end 552 of the lower surface portion 551 may be formed along the shapes of the recessed portion 531 and the bottom portion 532.

A plurality of fastening members 544*a* and 545*a* may be fastened to the lower surface portion 551. The fastening members 544*a* and 545*a* may be fastened to pass through the lower surface portion 551, the reinforcement frame 19, and the reinforcement member 55 in order, and thus the base 53, the reinforcement frame 19, and the reinforcement members 55 may maintain a strong coupled state to each other.

The side portion 553 may extend upward along the outer end of the lower surface portion 551. The side portion 553 may be continuously formed along the lower surface portion 551 and may be formed to be in contact with the outer case 11, the front surface of the machine room, and the border portion 533, respectively. Accordingly, in a state where the reinforcement member 55 is mounted inside the machine room 50, the reinforcement member 55 maintains a support state with each surface forming the corner of the machine room 50, and deformation thereof can be prevented.

In addition, an evacuation portion 554 may be formed at one side of the reinforcement member 55 corresponding to the vertical portion of the reinforcement frame 19. The evacuation portion 554 may be formed at a position facing the side bending portion 111 of the outer case 11 and may be formed to be spaced apart from the side bending portion 111. In other words, the reinforcement member 55 may be spaced apart from the reinforcement frame 19 mounted on the side bending portion 111, and when the reinforcement member 55 is mounted, it is possible to prevent the reinforcement member from interfering with the vertical portion.

The reinforcement member 55 and the reinforcement frame 19 may be respectively formed at both ends of the machine room 50. If the reinforcement member and the reinforcement frame 19 are provided on only one side of both side surfaces of the machine room 50, the reinforcement member 55 and the reinforcement frame 19 may be provided only on one side far from the position where the rotation axis C of the door 20 is disposed among the left and right sides.

Meanwhile, the refrigerator according to the embodiment of the present disclosure will be possible in various other embodiments in addition to the above-described embodiment. Another embodiment of the present disclosure is characterized in that the reinforcement member has a structure provided on the lower surface of the machine room. Accordingly, there is a difference only in the mounting position of the reinforcement member and some structures, and since other components are the same, descriptions and illustrations of the same components may be omitted, and the same reference numerals will be used.

Figure 9:
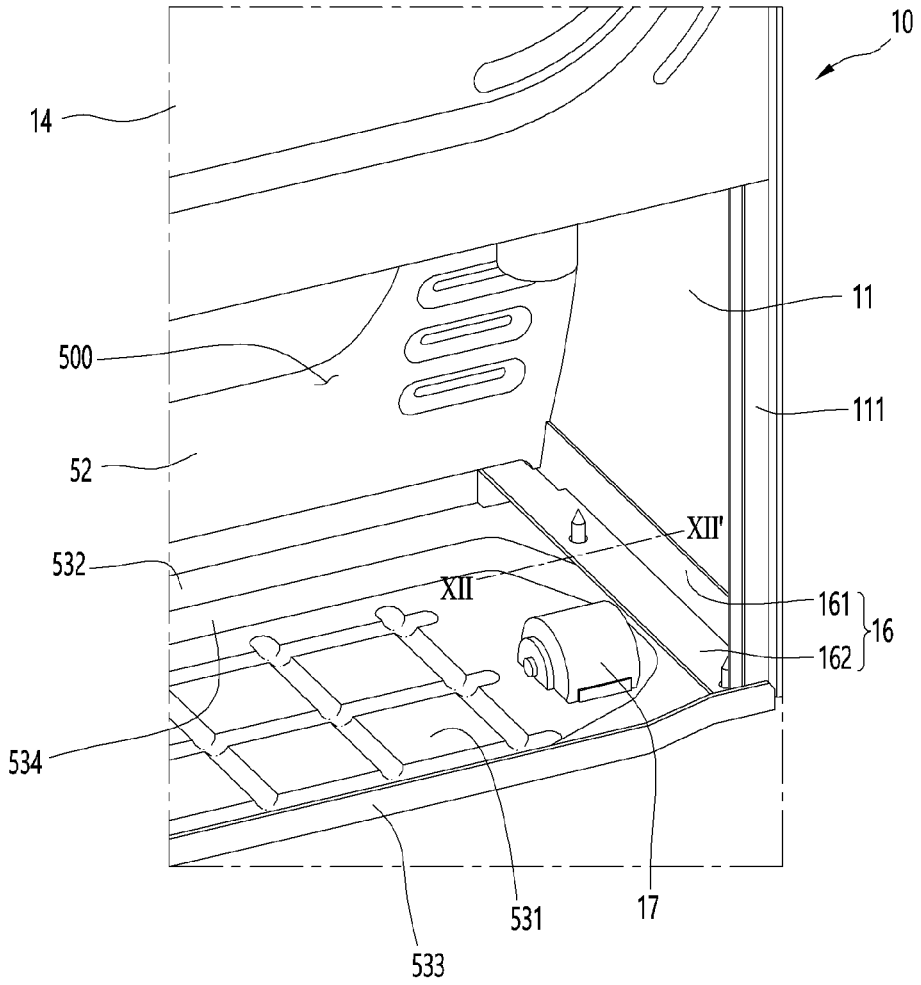
FIG. 9 is a partial perspective view illustrating a state of a machine room equipped with a reinforcement member according to another embodiment of the present disclosure.
Figure 10:
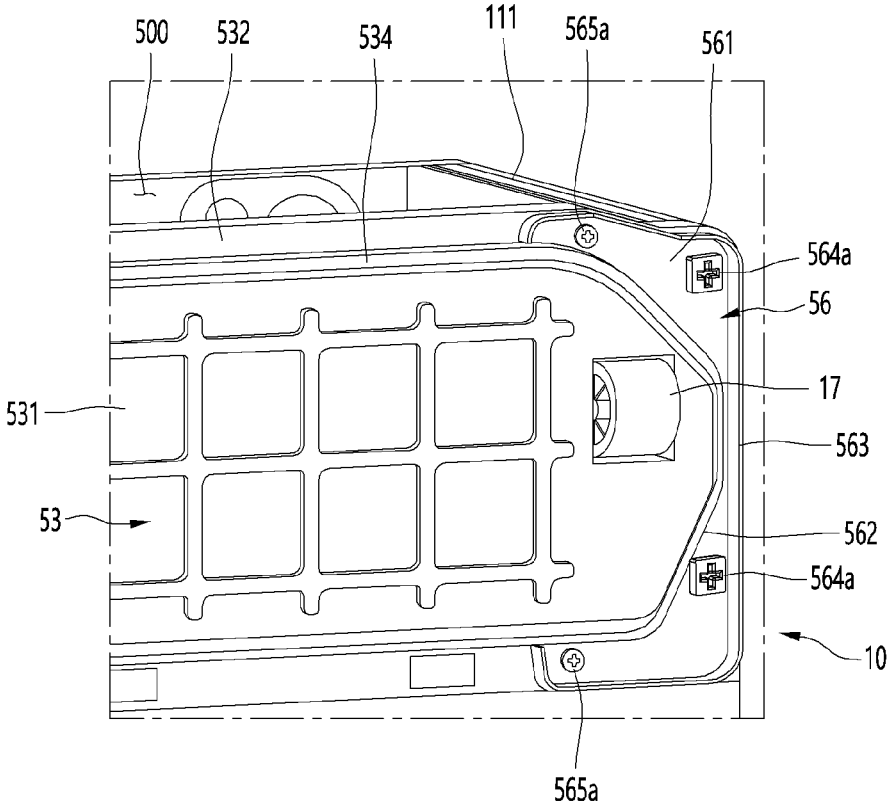
FIG. 10 is a partial perspective view illustrating the cabinet in a state where the reinforcement member is mounted, as viewed from below.
Figure 11:
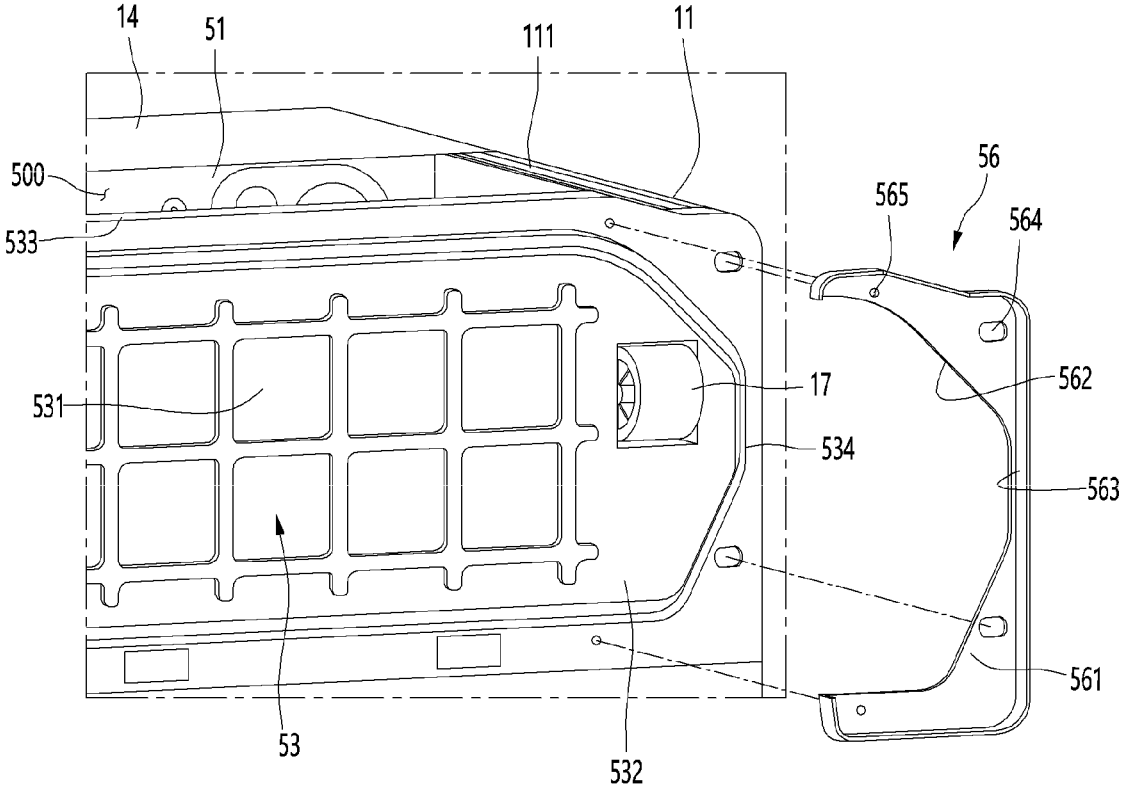
FIG. 11 is an exploded perspective view illustrating the mounting structure of the reinforcement member.
Figure 12:
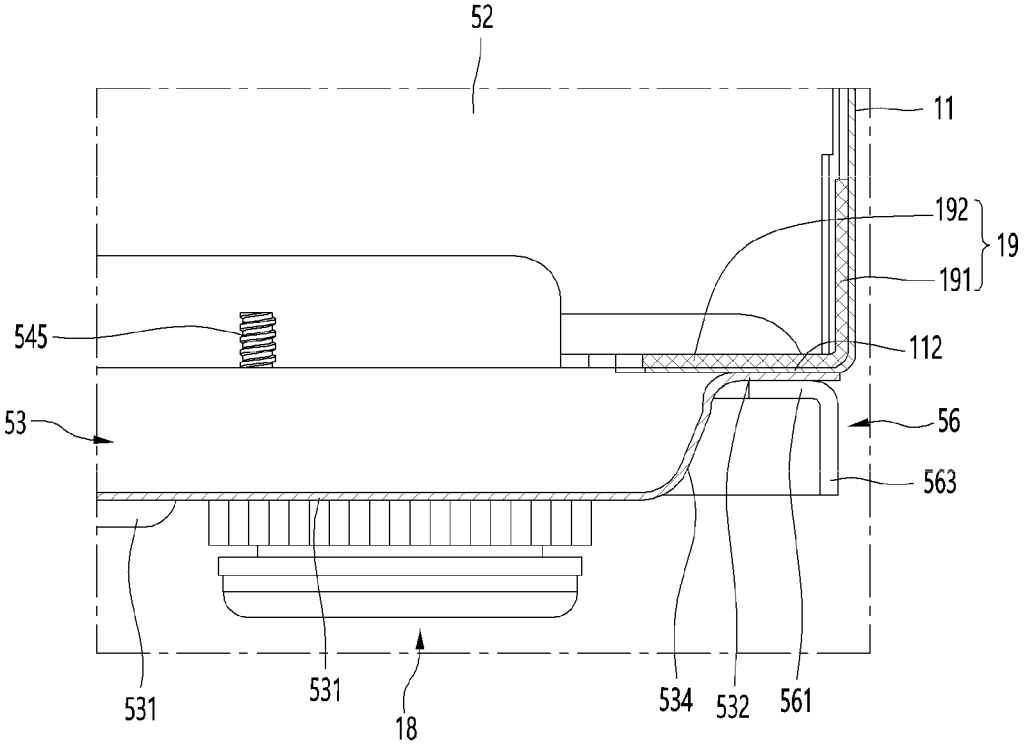
FIG. 12 is a cross-sectional view taken along line XII-XII' of FIG. 9.

FIG. 9 is a partial perspective view illustrating a state of a machine room equipped with a reinforcement member according to another embodiment of the present disclosure, FIG. 10 is a partial perspective view illustrating the cabinet in a state where the reinforcement member is mounted, as viewed from below, FIG. 11 is an exploded perspective view illustrating the mounting structure of the reinforcement member. and FIG. 12 is a cross-sectional view taken along line XII-XII' of FIG. 9.

As illustrated in the drawing, a machine room 50 may be provided under the cabinet 10. In addition, the bottom surface of the machine room 50 may be formed by the base 53. In addition, the base 53 may be combined with the upper surface plate 51, the front surface plate 52, and the outer case 11 to form a space 500 inside the machine room 50. The bent lower end and rear end of the outer case 11, that is, the lower bending portion 112 and the side bending portion 111 may be coupled to the base 53.

The base 53 may be formed of the plate-shaped metal material and may include a recessed portion 531, a bottom portion 532, and an border portion 533. The bottom portion 532 may form an edge of the base 53 and may extend upward along the circumference of the bottom portion 532. In addition, the recessed portion 531 may be further recessed downward than the bottom portion 532, and the outer end of the recessed portion 531 and the inner end of the bottom portion 532 may be connected by a circumferential portion 534.

In addition, a roller 17, a reinforcement frame 19, and a reinforcement member 56 may be mounted on the base 53.

The reinforcement frame 19 may be disposed at the corners of the lower surface and the rear surface of the machine room 50, and may be composed of the vertical portion and the horizontal portion. The horizontal portion may include a first horizontal portion 191 in contact with the base 53 or lower bending portion 112, and a second horizontal portion 192 in contact with a side surface of the outer case 11. In addition, the vertical portion may include a first vertical portion 193 in contact with the side bending portion 111 and a second vertical portion 194 in contact with a side surface of the outer case 11. In addition, the reinforcement frame 19 may be coupled to the outer case 11 by a plurality of screws.

The reinforcement member 56 may be formed of a metal material and may form a lower surface of the machine room 50, that is, a portion of the bottom of the cabinet 10. The reinforcement member 56 may be provided at both ends of the machine room 50 in the left and right direction. If the reinforcement member 56 is provided only at one end of both ends of the machine room 50 in the left and right direction, the reinforcement member may form in one end far from the rotation axis C of the door 20 among the left and right both ends of the machine room 50.

In addition, the reinforcement member 56 may be provided on the lower surface of the base 53, that is, on the outer surface of the machine room 50. The reinforcement member 56 may include a lower surface portion 561 seated on a lower surface of the bottom portion 532, and a side portion 563 extending downward along an outer circumference of the lower surface portion 561.

The lower surface portion 561 may be formed over a portion of the side end, the front end, and the rear end of the bottom portion 532 and may be formed in a plate shape corresponding to the shape of the bottom portion 532 to be in close contact with the lower surface of the bottom portion 532. In this case, the inner end of the lower surface portion 561 may be formed along the shapes of the recessed portion 531 and the bottom portion 532.

Accordingly, in the state where the reinforcement member 56 is mounted, the recessed portion 531 protrudes further downward than the reinforcement member 56, and the outer end of the recessed portion 531 may be formed in the same shape as the inner end 562 of the lower surface portion 561 to be in contact with each other.

Fastening holes 564,565 to which a plurality of fastening members 564*a* and 565*a* are fastened may be formed in the lower surface portion 561. The fastening members 564*a* and 565*a* may be fastened to pass through the lower surface portion 561, the reinforcement frame 19, and the reinforcement member 56 in order, and thus the base 53, the reinforcement frame 19 and the reinforcement members 56 may maintain a strong coupled state to each other.

The side portion 563 may extend downward along the outer end of the lower surface portion 561. The reinforcement member 56 may have a structure more resistant to deformation by the side portion 563. The side portion 563 may be continuously formed along the lower surface portion 561 and may be formed along the outer case 11 and the border portion 533.

Meanwhile, the structure of the machine room and the structure of the reinforcement member of the above-described embodiments may be applied to refrigerators having various other structures in addition to the refrigerator of the above-described embodiment.

Figure 13:
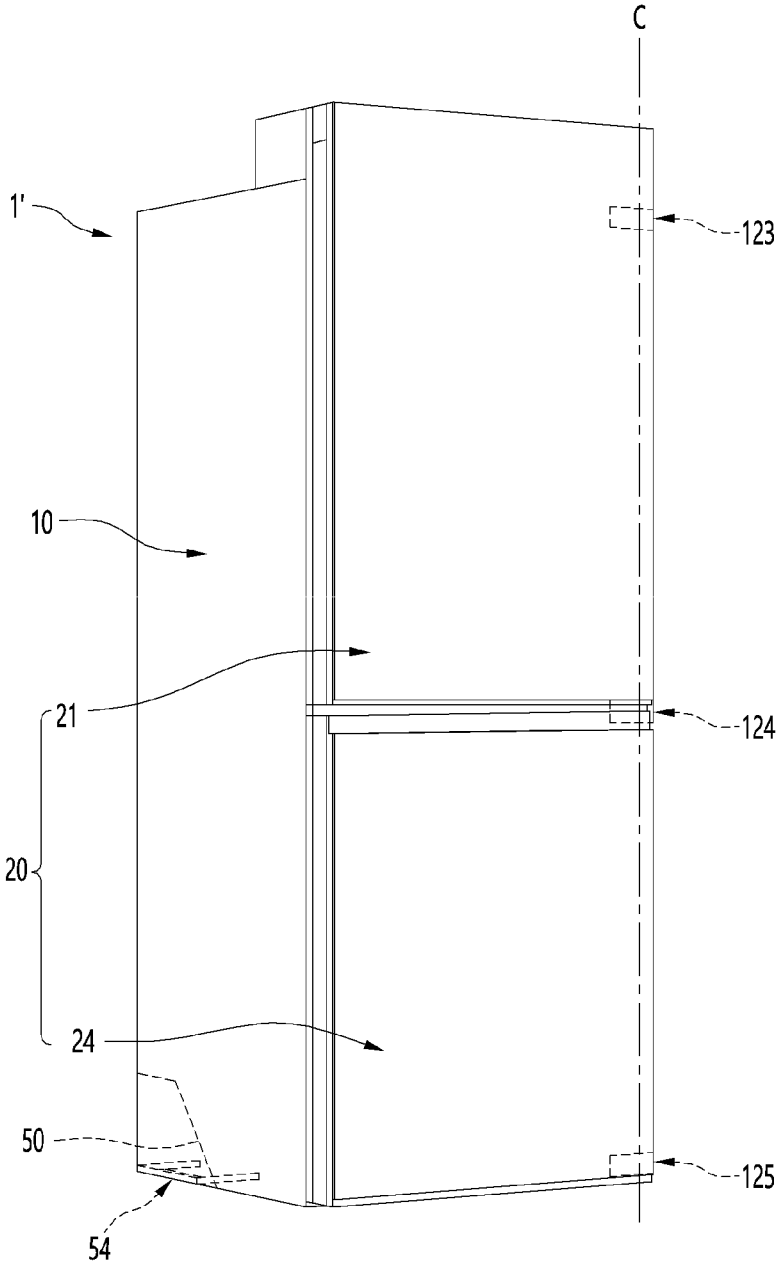
FIG. 13 is a perspective view illustrating a refrigerator according to another embodiment of the present disclosure.

FIG. 13 is a perspective view illustrating a refrigerator according to another embodiment of the present disclosure.

As illustrated in FIG. 13, the door 20 of the refrigerator 1' according to another embodiment of the present disclosure includes an upper door 21 and a lower door 24, and all of the upper door 24 and the lower doors 24 may be rotatably coupled to the cabinet 10 by hinge devices 123, 124, and 125. In addition, the storage space may be opened and closed by rotation of the upper door 21 and the lower door 24.

In detail, the hinge devices 123, 124, and 125 may include an upper hinge 123 shaft-coupled to the upper end of the upper door 21, and an intermediate hinge shaft-coupled to the lower end of the upper door 21 and the upper end of the lower door 24. 124, and a lower hinge 125 axially coupled to the lower end of the lower door 24.

The intermediate hinge 124 may have a single configuration, and may be rotatably coupled to the upper door 21 and the lower door 24 by a plurality of hinge shafts. Of course, two of the intermediate hinges 124 may be configured to be vertically disposed to support the upper door 21 and the lower door 24, respectively.

In this case, the reinforcement members 54, 55, and 56 may be provided in the machine room 50. The reinforcement members 54, 55, and 56 may be provided in the machine room 50, and are provided at one end farther from the rotation axis C of the upper door 21 and the lower door 24 among both sides of the machine room in the left and right direction.

In addition, the reinforcement member 54 may be disposed below at least the intermediate hinge 124 among the plurality of hinge devices 123, 124, and 125.

The structure of the reinforcement member 54 and the disposition structure in the machine room 50 may be the same as those of the above-described embodiment.

Meanwhile, the present invention may be implemented in various other embodiments in addition to the above-described embodiments.

Figure 14:
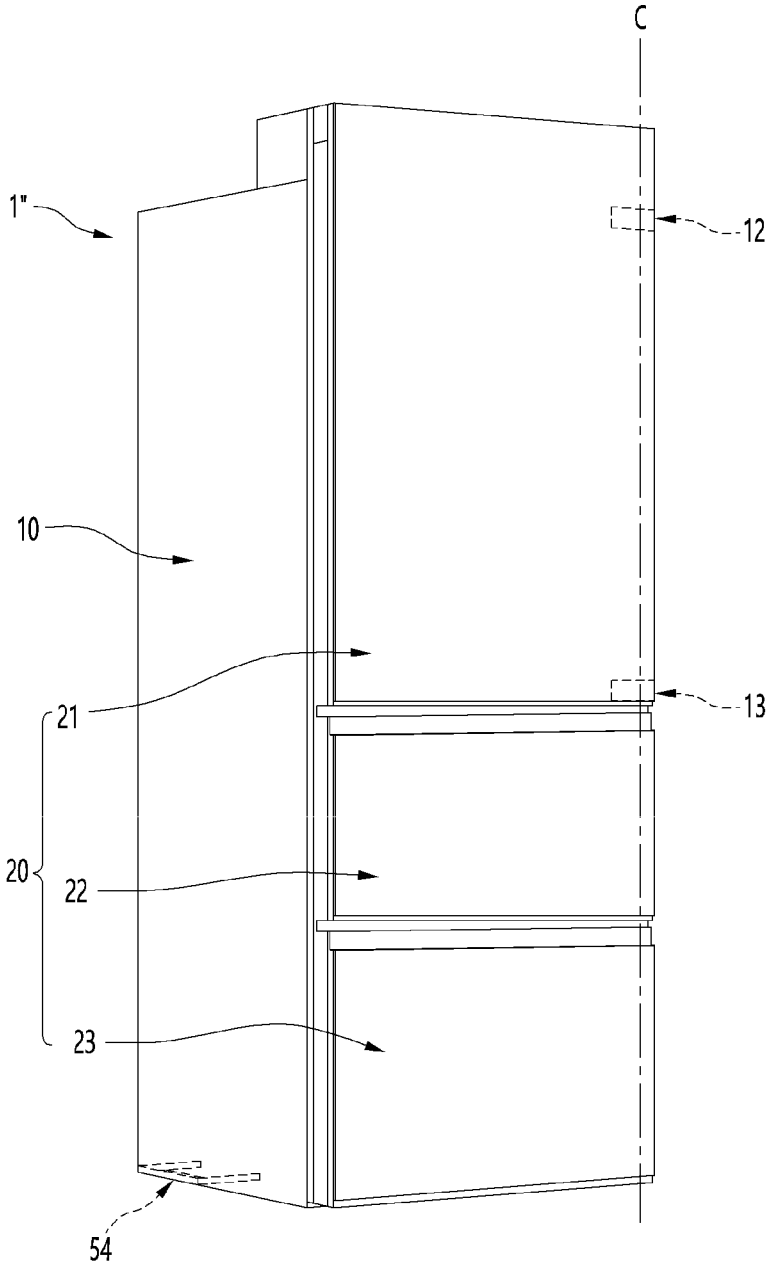
FIG. 14 is a perspective view illustrating a refrigerator according to another embodiment of the present disclosure.

FIG. 14 is a perspective view illustrating a refrigerator according to another embodiment of the present disclosure.

As illustrated in the drawing, a refrigerator 1" according to another embodiment of the present disclosure may include a cabinet 10 forming a storage space and a door 20 for opening and closing the front surface of the cabinet 10.

The cabinet 10 may be formed in a hexahedral shape with an open front surface, and may include an upper surface and a lower surface, both side surfaces in the left and right direction, and a rear surface. In this case, each surface of the cabinet 10 may be formed by being connected to each other in at least one configuration.

The door 20 may include a first door 21 that opens and closes a storage space above the cabinet 10, and a second door 22 and a third door 23 that are sequentially disposed below the first door 21. The first door 21 is a rotary door that is opened and closed by rotation, and hinge devices 12 and 13 connecting the first door 21 and the cabinet may be shaft-coupled at upper and lower ends of the first door 21. The hinge devices 12 and 13 may include an upper hinge 12 coupled to an upper end of the first door 21 and a lower hinge 13 coupled to a lower end of the first door 21. The rotation shafts of the upper hinge 12 and the lower hinge 13 are positioned on the same extension line, and form the rotation axis C of the first door 21.

In addition, the reinforcement member 54' may be provided at a corner of the lower end of the rear surface of the cabinet 10 that is farthest from the mounting positions of the hinge devices 12 and 13. The reinforcement member 54' may be mounted on the inner surface or the outer surface of the cabinet 10 and may prevent deformation caused by a load applied at the mounting position of the hinge device 12 and 13.

In other words, the reinforcement member 54' is disposed at the corner of the lower end of the rear surface of the cabinet 10 in which the greatest torsional moment can be generated the by the load applied by the hinge devices 12 and 13 irrespective of the position of the machine room to reinforce the strength of the cabinet 10 and prevent deformation of the cabinet 10.

The reinforcement member 54' may be formed of a metal material. In addition, the structure and shape of the reinforcement member 54' may vary, and for example, may be the same as the reinforcement member 54, 55, and 56 of the above-described embodiment.

What is claimed is:

1. A refrigerator comprising:

a cabinet defining a storage space;

a door configured to open and close the storage space;

a hinge rotatably coupling the door to the cabinet;

a reinforcement member provided at a first side opposite to the hinge among left and right sides of a lower surface of the cabinet and configured to block deformation of the cabinet; and a machine room provided at a lower end of a rear surface of the cabinet and having a base defining a bottom surface of the machine room and on which a compressor is received, wherein the reinforcement member includes:

a lower surface portion received at the bottom surface of the machine room, and a side portion that extends upward along a circumference of the lower surface portion and that contacts a side surface of the cabinet, wherein the base includes:

a bottom portion defining an edge of the machine room, and a recessed portion that is recessed downward from the bottom portion and in which the compressor is received, and wherein the reinforcement member is disposed at the bottom portion of the base.

2. The refrigerator of claim 1, wherein the reinforcement member is disposed at a corner defined by a rear surface, a side surface, and a lower surface of the cabinet.

3. The refrigerator of claim 2, wherein the reinforcement member is disposed at the lower surface of the cabinet and contacts at least one of the side surface or the rear surface of the cabinet.

4. The refrigerator of claim 1, wherein the reinforcement member is disposed at the lower surface of the cabinet and faces a bottom surface of the cabinet.

5. The refrigerator of claim 1, wherein the reinforcement member is disposed at a corner defined by a lower surface of the machine room and a side surface of the machine room and supports both the lower surface and the side surface.

6. The refrigerator of claim 1, wherein the cabinet includes an outer case that defines (i) both side surfaces of the machine room in a left and right direction and (ii) an outer appearance of the cabinet, and wherein the base supports the lower surface portion of the reinforcement member, and the outer case supports the side portion of the reinforcement member.

7. The refrigerator of claim 6, further comprising:

a reinforcement frame that is made of metal material, that is provided along an edge of a lower surface and a side surface of the machine room, and that is configured to receive the reinforcement member, wherein the reinforcement member is coupled to the reinforcement frame by a fastening member that passes through the reinforcement member, the lower surface of the machine room, and the reinforcement frame.

8. The refrigerator of claim 7, wherein the reinforcement frame includes:

a horizontal portion contacting a first end of the lower surface of the machine room and the lower end of the side surface of the outer case, and a vertical portion contacting a first end of the rear surface of the machine room and a rear end of the side surface of the outer case, and wherein the reinforcement member is disposed at the horizontal portion.

9. The refrigerator of claim 6, further comprising:

a lower bending portion extending to contact with the base at the lower end of the outer case, wherein the reinforcement member is coupled to the base by a fastening member passing through the base, the lower bending portion, and the reinforcement member.

10. The refrigerator of claim 1, wherein an inner end of the lower surface portion of the reinforcement member is provided along an outer side of the recessed portion of the base, and wherein an outer end of the lower surface portion of the reinforcement member is provided along an outer side of the bottom portion of the base.

11. The refrigerator of claim 1, wherein the base extends upward along a circumference of the bottom portion and has an edge portion coupled to a circumferential surface of the machine room, and wherein the side portion of the reinforcement member contacts the edge portion of the base.

12. The refrigerator of claim 1, wherein the lower surface portion includes:

a first lower surface portion extending along a side end of the machine room, a second lower surface portion extending along a front end of the machine room from a front end of the first lower surface portion, and a third lower surface portion extending along a rear end of the machine room from a rear end of the first lower surface portion.

13. The refrigerator of claim 12, wherein the side portion of the reinforcement member includes:

a first side surface portion extending from the first lower surface portion and contacting the side surface of the cabinet, a second side surface portion extending from the second lower surface portion and contacting a front surface plate defining a front surface of the machine room, and a third side surface portion extending from the third lower surface portion and contacting an edge portion extending upward along the circumference of the bottom portion.

14. The refrigerator of claim 1, wherein the side portion is provided along the circumferences of a side end, a front end, and a rear end of the lower surface of the machine room.

15. The refrigerator of claim 1, wherein the reinforcement member is provided at both ends of a bottom surface of the machine room in a left and right direction.

16. The refrigerator of claim 1, wherein the reinforcement member is made of a metal material a having strength greater than strength of the cabinet.

* * * * *